US011142978B2

(12) United States Patent
Deng et al.

(10) Patent No.: US 11,142,978 B2
(45) Date of Patent: Oct. 12, 2021

(54) PACKER ASSEMBLY INCLUDING AN INTERLOCK FEATURE

(71) Applicants: Guijun Deng, The Woodlands, TX (US); Alexander Kendall, Houston, TX (US); YingQing Xu, Tomball, TX (US)

(72) Inventors: Guijun Deng, The Woodlands, TX (US); Alexander Kendall, Houston, TX (US); YingQing Xu, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/711,840

(22) Filed: Dec. 12, 2019

(65) Prior Publication Data

US 2021/0180420 A1 Jun. 17, 2021

(51) Int. Cl.
*E21B 23/06* (2006.01)
*E21B 33/128* (2006.01)

(52) U.S. Cl.
CPC ..... *E21B 23/06* (2013.01); *E21B 33/128* (2013.01)

(58) Field of Classification Search
CPC ..... E21B 23/06; E21B 33/128
See application file for complete search history.

(56) References Cited

U.S. PATENT DOCUMENTS 2,603,294 A * 7/1952 Barnes ..... E21B 33/128 166/138
2,726,722 A 12/1955 Baker
2,767,795 A 10/1956 Bush
2,797,759 A 7/1957 Long et al.
2,885,009 A 5/1959 Baker
2,921,633 A * 1/1960 Baker ..... E21B 33/1216 277/338
2,945,541 A 7/1960 Maly et al.
3,229,767 A 1/1966 Carter
3,298,440 A 1/1967 Current
(Continued)

FOREIGN PATENT DOCUMENTS

AU 2015397127 B2 12/2016
EP 1197632 A2 4/2002
(Continued)

OTHER PUBLICATIONS

International Search Report and Written Opinion for International Application No. PCT/US2020/024843; International Filing Date Mar. 26, 2020; Report dated Jul. 13, 2020 (pp. 1-10).
(Continued)

*Primary Examiner* — Nicole Coy
(74) *Attorney, Agent, or Firm* — Cantor Colburn LLP

(57) ABSTRACT

A packer assembly includes a tubular having a surface, a gauge ring provided on the surface, a back-up ring positioned adjacent the gauge ring, a packer element arranged adjacent to the back-up ring, an expansion ring arranged adjacent to the gauge ring, the expansion ring including a step portion, and a support ring arranged axially between the back-up ring and the expansion ring. The support ring includes a step feature. The step portion and the step feature are selectively engaged with expansion of the packer element to form an interlock feature that substantially limits rocking of the expansion ring.

12 Claims, 4 Drawing Sheets

(56) References Cited

U.S. PATENT DOCUMENTS

| | | | |
|---|---|---|---|
| 3,313,553 | A | 4/1967 | Gastineau |
| 3,343,607 | A | 9/1967 | Current |
| 3,358,766 | A | 12/1967 | Current |
| 3,381,969 | A | 5/1968 | Crow et al. |
| 3,385,679 | A | 5/1968 | Current |
| 3,481,611 | A | 12/1969 | Stratton |
| 3,517,742 | A | 6/1970 | Williams |
| 3,960,311 | A | 6/1976 | Griffiths |
| 4,204,690 | A | 5/1980 | Holland et al. |
| 4,349,204 | A | 9/1982 | Malone |
| RE31,933 | E | 7/1985 | Taylor et al. |
| 4,665,978 | A | 5/1987 | Luke |
| 4,753,444 | A | 6/1988 | Jackson et al. |
| 4,765,404 | A | 8/1988 | Bailey et al. |
| 4,852,394 | A | 8/1989 | Lazes |
| 4,892,144 | A | 1/1990 | Coone |
| 4,910,832 | A | 3/1990 | Schaub et al. |
| 5,027,894 | A | 7/1991 | Coone et al. |
| 5,161,806 | A | 11/1992 | Balsells |
| 5,311,938 | A | 5/1994 | Hendrickson et al. |
| 5,678,635 | A | 10/1997 | Dunlap et al. |
| 6,318,482 | B1 | 11/2001 | Fidtje |
| 6,431,274 | B1 | 7/2002 | Tedham et al. |
| 6,513,600 | B2 | 2/2003 | Ross |
| 6,581,682 | B1 | 6/2003 | Parent et al. |
| 6,598,672 | B2 | 7/2003 | Bell et al. |
| 6,695,050 | B2 | 2/2004 | Winslow et al. |
| 6,695,051 | B2 | 2/2004 | Smith et al. |
| 6,712,153 | B2 | 3/2004 | Turley et al. |
| 6,769,491 | B2 | 8/2004 | Zimmerman et al. |
| 6,840,328 | B2 | 1/2005 | McKee et al. |
| 7,124,826 | B2 | 10/2006 | Simpson |
| 7,178,601 | B2 | 2/2007 | Burge |
| 7,273,110 | B2 | 9/2007 | Pedersen et al. |
| 7,306,034 | B2 | 12/2007 | Garcia |
| 7,341,110 | B2 | 3/2008 | Doane et al. |
| 7,424,909 | B2 | 9/2008 | Roberts et al. |
| 7,665,516 | B2 | 2/2010 | Roberts et al. |
| 7,708,080 | B2 | 5/2010 | Conaway et al. |
| 7,780,399 | B1 | 8/2010 | Garrison |
| 8,151,873 | B1 | 4/2012 | Lee et al. |
| 8,151,894 | B2 | 4/2012 | Nutley et al. |
| 8,205,671 | B1 | 6/2012 | Branton |
| 8,276,678 | B2 | 10/2012 | Burnett et al. |
| 8,327,929 | B2 | 12/2012 | Reid et al. |
| 8,403,036 | B2 | 3/2013 | Neer et al. |
| 8,469,088 | B2 | 6/2013 | Shkurti et al. |
| 8,479,809 | B2 | 7/2013 | Farquhar |
| 8,662,161 | B2 | 3/2014 | Lee et al. |
| 8,701,787 | B2 | 4/2014 | Shkurti et al. |
| 8,839,874 | B2 | 9/2014 | Bishop et al. |
| 8,910,722 | B2 * | 12/2014 | Bishop ..... E21B 33/128 166/387 |
| 9,194,206 | B2 | 11/2015 | Xu et al. |
| 9,260,936 | B1 | 2/2016 | Branton |
| 9,587,458 | B2 | 3/2017 | Derby |
| 9,845,658 | B1 | 12/2017 | Nish et al. |
| 10,087,704 | B2 * | 10/2018 | Conner ..... E21B 33/128 |
| 10,329,870 | B2 * | 6/2019 | Xu ..... E21B 33/1216 |
| 10,435,972 | B2 | 10/2019 | Crump et al. |
| 2002/0043368 | A1 | 4/2002 | Bell et al. |
| 2003/0037932 | A1 | 3/2003 | Guillory et al. |
| 2003/0226659 | A1 | 12/2003 | Smith et al. |
| 2004/0134659 | A1 | 7/2004 | Hoffman et al. |
| 2004/0150165 | A1 | 8/2004 | Grondahl et al. |
| 2005/0189103 | A1 | 9/2005 | Roberts et al. |
| 2006/0289173 | A1 | 12/2006 | Conaway et al. |
| 2007/0125532 | A1 | 6/2007 | Murray et al. |
| 2007/0200299 | A1 | 8/2007 | Kunz |
| 2007/0256827 | A1 | 11/2007 | Guerrero et al. |
| 2007/0261863 | A1 | 11/2007 | Macleod et al. |
| 2008/0041583 | A1 | 2/2008 | Angman et al. |
| 2008/0060821 | A1 | 3/2008 | Smith et al. |
| 2008/0061510 | A1 | 3/2008 | Li et al. |
| 2008/0135240 | A1 | 6/2008 | Brennan et al. |
| 2008/0190600 | A1 | 8/2008 | Shkurti et al. |
| 2009/0065191 | A1 | 3/2009 | Reid et al. |
| 2009/0159265 | A1 | 6/2009 | Freyer |
| 2009/0255690 | A1 | 10/2009 | Conner et al. |
| 2009/0277648 | A1 | 11/2009 | Nutley et al. |
| 2009/0283254 | A1 | 11/2009 | Andersen et al. |
| 2009/0308592 | A1 | 12/2009 | Mercer et al. |
| 2010/0038074 | A1 | 2/2010 | Patel |
| 2010/0186970 | A1 | 7/2010 | Burnett |
| 2010/0276137 | A1 | 11/2010 | Nutley et al. |
| 2010/0294485 | A1 | 11/2010 | Lynde et al. |
| 2011/0037229 | A1 | 2/2011 | Clarke |
| 2011/0101615 | A1 | 5/2011 | Clarke |
| 2011/0297368 | A1 | 12/2011 | Lembcke |
| 2012/0018143 | A1 | 1/2012 | Lembcke |
| 2012/0037355 | A1 | 2/2012 | Bishop et al. |
| 2012/0073830 | A1 | 3/2012 | Lembcke et al. |
| 2012/0133098 | A1 | 5/2012 | Farquhar |
| 2012/0145412 | A1 | 6/2012 | Andersen et al. |
| 2012/0217025 | A1 | 8/2012 | Shkurti et al. |
| 2012/0305236 | A1 | 12/2012 | Gouthaman |
| 2013/0147120 | A1 | 6/2013 | O'Malley |
| 2013/0213672 | A1 | 8/2013 | Nutley et al. |
| 2013/0306330 | A1 | 11/2013 | Bishop et al. |
| 2013/0306331 | A1 | 11/2013 | Bishop et al. |
| 2014/0034335 | A1 | 2/2014 | Nutley et al. |
| 2014/0262351 | A1 | 9/2014 | Derby |
| 2014/0265161 | A1 | 9/2014 | Sutterfield et al. |
| 2014/0290946 | A1 | 10/2014 | Nguyen et al. |
| 2014/0352970 | A1 | 12/2014 | Kristoffer |
| 2015/0101796 | A1 | 4/2015 | Davies et al. |
| 2015/0115539 | A1 | 4/2015 | Guenther et al. |
| 2015/0308214 | A1 | 10/2015 | Bilansky et al. |
| 2015/0330174 | A1 | 11/2015 | Craigon et al. |
| 2015/0354313 | A1 | 12/2015 | McClinton et al. |
| 2016/0109025 | A1 | 4/2016 | McCarrey et al. |
| 2016/0208632 | A1 | 7/2016 | Davis et al. |
| 2016/0369586 | A1 | 12/2016 | Morehead et al. |
| 2016/0376869 | A1 | 12/2016 | Rochen et al. |
| 2017/0191340 | A1 | 7/2017 | Dent et al. |
| 2017/0342797 | A1 | 11/2017 | Murphree et al. |
| 2018/0010418 | A1 | 1/2018 | Vanlue |
| 2018/0023366 | A1 | 1/2018 | Deng et al. |
| 2018/0106125 | A1 | 4/2018 | Deng et al. |
| 2018/0298716 | A1 | 10/2018 | Cayson et al. |
| 2018/0298718 | A1 | 10/2018 | Cayson et al. |
| 2019/0017347 | A1 | 1/2019 | Kendall et al. |
| 2019/0040710 | A1 | 2/2019 | Deng et al. |
| 2019/0078413 | A1 | 3/2019 | Kendall et al. |
| 2019/0120011 | A1 | 4/2019 | Kellner |
| 2019/0169951 | A1 | 6/2019 | Frazier |
| 2019/0249511 | A1 | 8/2019 | Deng et al. |
| 2019/0345791 | A1 | 11/2019 | Kendall et al. |
| 2019/0352997 | A1 | 11/2019 | Brown |
| 2019/0368304 | A1 | 12/2019 | Deng et al. |
| 2020/0165893 | A1 * | 5/2020 | Varhaug ..... E21B 33/122 |
| 2020/0232298 | A1 * | 7/2020 | Deng ..... E21B 33/1216 |
| 2020/0308920 | A1 | 10/2020 | Deng et al. |
| 2021/0010343 | A1 | 1/2021 | Deng et al. |

FOREIGN PATENT DOCUMENTS

| | | | |
|---|---|---|---|
| WO | 2006046075 | A2 | 5/2006 |
| WO | 2006121340 | A1 | 11/2006 |
| WO | 2009074785 | A2 | 6/2009 |
| WO | 2013128222 | A1 | 9/2013 |
| WO | 2019014482 | A1 | 1/2019 |

OTHER PUBLICATIONS

International Search Report and Written Opinion for International Application No. PCT/US2020/063869; International Filing Date Dec. 9, 2020; Report dated Mar. 29, 2021 (pp. 1-7).

Notification of Transmittal of the International Search Report and the Written Opinion of the International Searching Authority, or the Declaration; PCT/2021/013919; dated Apr. 15, 2021; (pp. 1-11).

(56) References Cited

OTHER PUBLICATIONS

Notification of Transmittal of the International Search Report and the Written Opinion of the International Searching Authority, or the Declaration; PCT/US2018/027359; dated Aug. 1, 2018; (pp. 1-11).
Notification of Transmittal of the International Search Report and the Written Opinion of the International Searching Authority, or the Declaration; PCT/US2018/041880; dated Nov. 21, 2018; (pp. 1-13).
Notification of Transmittal of the International Search Report and the Written Opinion of the International Searching Authority, or the Declaration; PCT/US2020/019872; dated Jun. 19, 2020; (pp. 1-13).
Notification of Transmittal of the International Search Report and the Written Opinion of the International Searching Authority; PCT/US2018/050395; dated Jan. 2, 2019; (pp. 1-13).

* cited by examiner

PACKER ASSEMBLY INCLUDING AN INTERLOCK FEATURE

BACKGROUND

Resource exploration and recovery systems often employ packers along a tubing string. The packers creates zones in a formation that may be isolated from one another. Typically, the packer is mounted to an outer surface of a tubular forming a portion of the tubing string. The tubing string is run into the formation to a desired depth and the packer is activated. In many cases, the packer is activated by a shifting tool. A ring, arranged on one side of the packer, is shifted toward a ring that may be constrained on an opposite side. The shifting of the ring causes the packer to axially compress and radially expand. Generally, a back-up ring is employed to limit axial extrusion of the packer.

The back-up ring, under certain applications, is prone to shearing, causing the packer to fail. As such, often times, a support ring and an expansion ring are employed to limit back-up ring shear. The support ring guides the expansion ring radially outwardly and axially inwardly to buttress the back-up ring. Given the forces being applied to the expansion ring, some twisting may occur. The twisting or rocking detracts from the buttressing effect provided by the expansion ring.

SUMMARY

In an embodiment, a packer assembly includes a tubular having a surface, a gauge ring provided on the surface, a back-up ring positioned adjacent the gauge ring, a packer element arranged adjacent to the back-up ring, an expansion ring arranged adjacent to the gauge ring, the expansion ring including a step portion, and a support ring arranged axially between the back-up ring and the expansion ring. The support ring includes a step feature. The step portion and the step feature are selectively engaged with expansion of the packer element to form an interlock feature that substantially limits rocking of the expansion ring.

In another embodiment, a resource exploration and recovery system includes a surface system, and a downhole system including a string of tubulars. At least one of the string of tubulars includes a surface supporting a packer assembly. The packer assembly includes a gauge ring provided on the surface, a back-up ring positioned adjacent the gauge ring, a packer element arranged adjacent to the back-up ring, an expansion ring arranged adjacent to the gauge ring, the expansion ring including a step portion, and a support ring arranged axially between the back-up ring and the expansion ring. The support ring includes a step feature. The step portion and the step feature are selectively engaged with expansion of the packer element to form an interlock feature that substantially limits rocking of the expansion ring.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
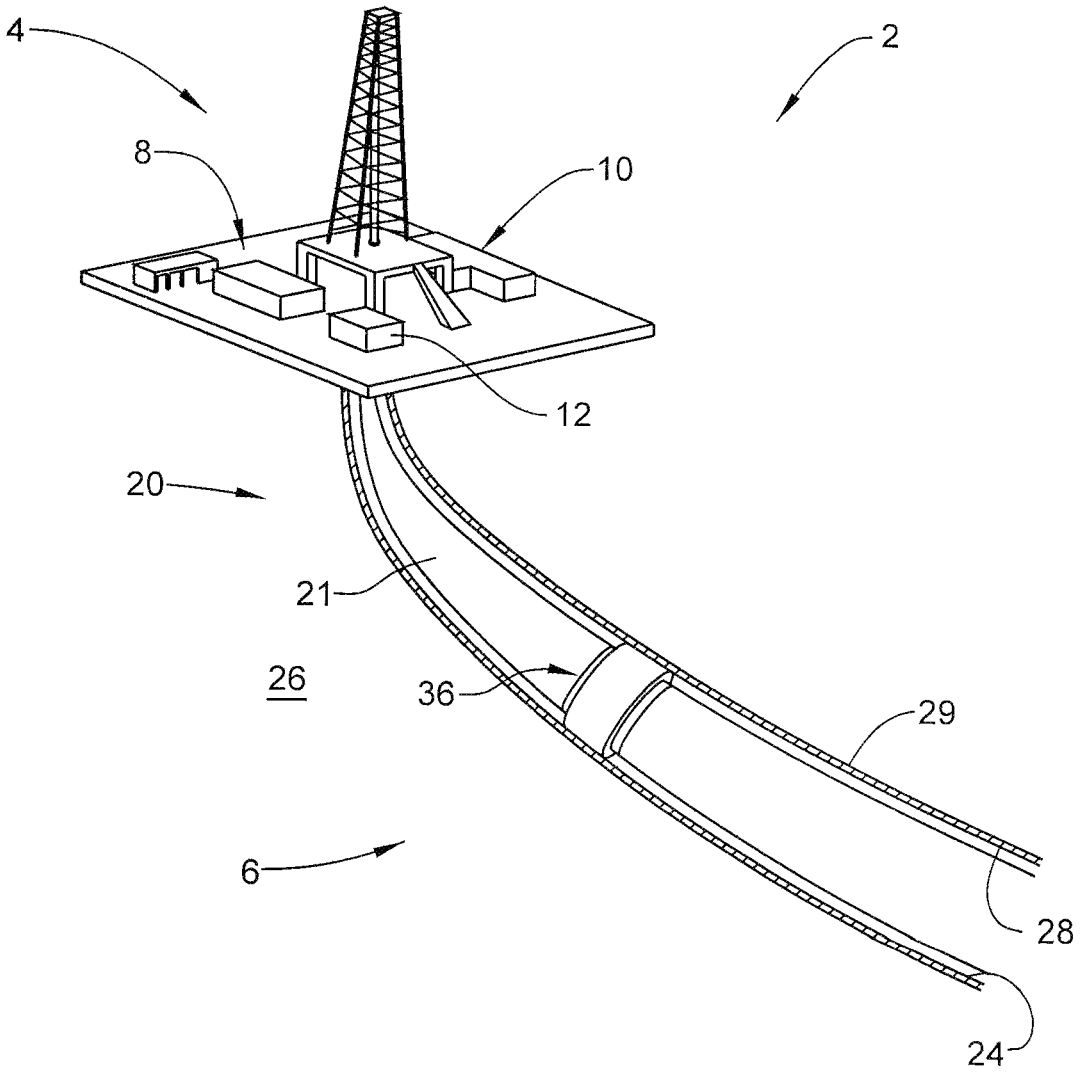
FIG. 1 depicts a resource exploration and recovery system having a packer assembly including an expansion ring and support ring having an anti-rocking feature and a packer, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a surface system 4 operatively and fluidically connected to a downhole system 6. Surface system 4 may include pumps 8 that aid in completion and/or extraction processes as well as fluid storage 10. Fluid storage 10 may contain a gravel pack fluid or slurry (not shown) or other fluid which may be introduced into downhole system 6. Surface system 4 may also include a control system 12 that may monitor and/or activate one or more downhole operations.

Downhole system 6 may include a downhole string 20 formed from a plurality of tubulars, one of which is indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by a surface of formation 26. Downhole string 20 may include a packer assembly 36 that may be selectively expanded into engagement with annular wall 28.

Figure 2:
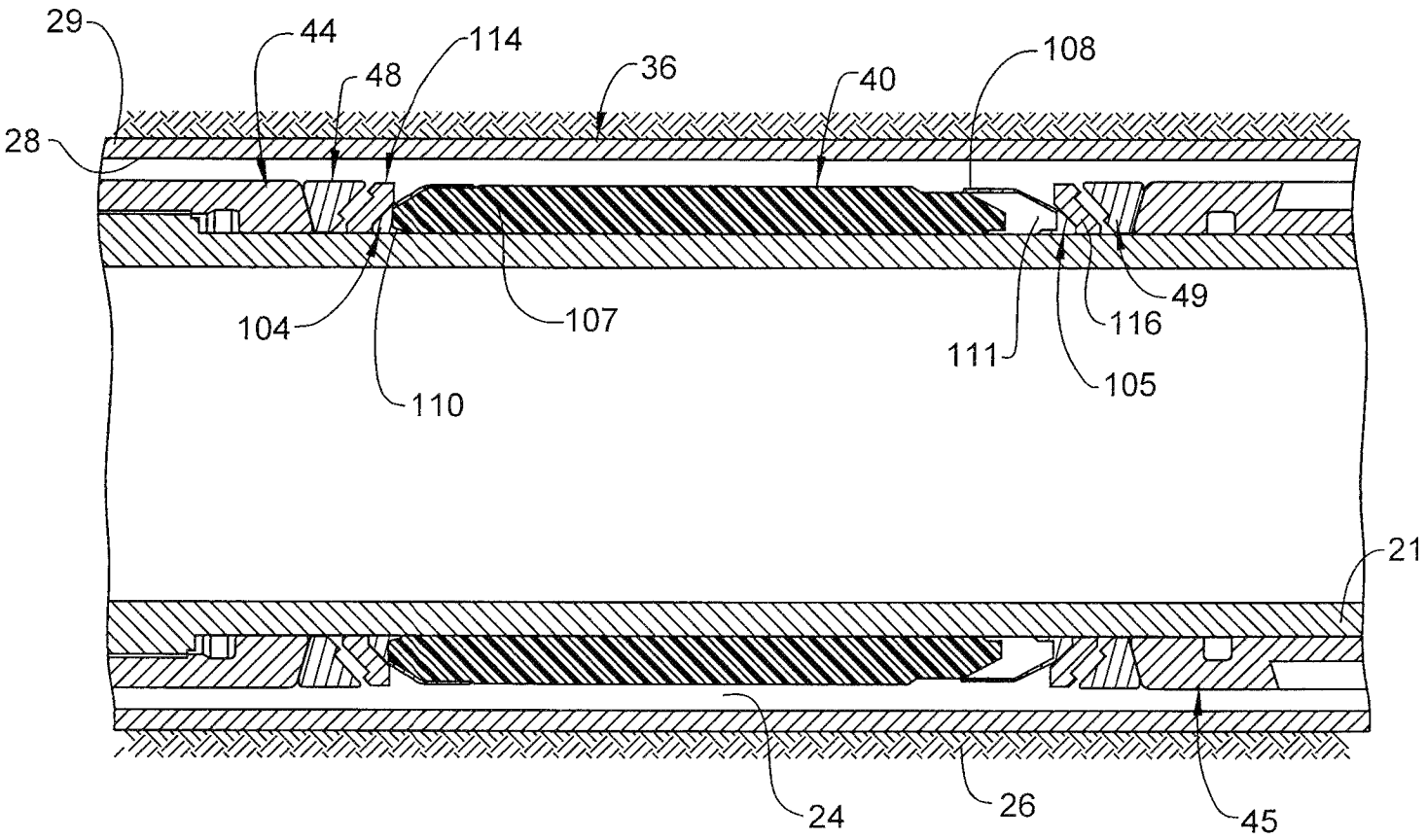
FIG. 2 depicts a cross-sectional view of the packer assembly of FIG. 1.
Figure 3:
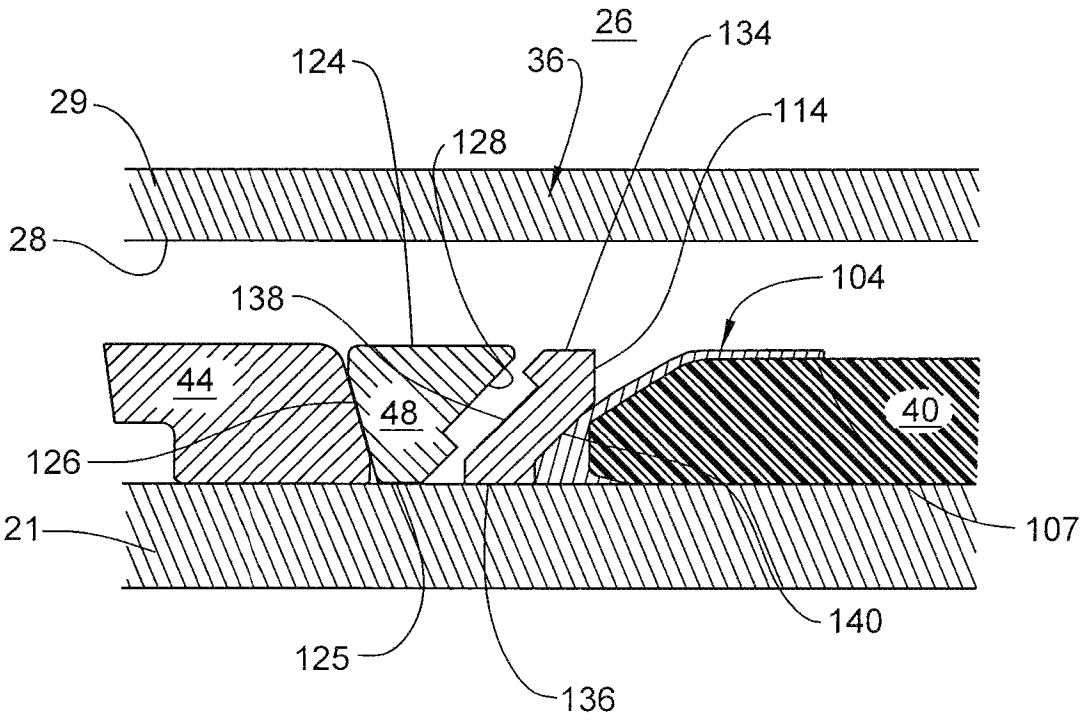
FIG. 3 is a partial sectional view of the packer assembly of FIG. 2 with the packer in a non-deployed configuration.

With reference to FIGS. 2 and 3, packer assembly 36 includes an a packer element in the form of an elastomeric member 40 that is selectively radially outwardly expanded into contact with annular wall 28 of wellbore casing 29. It should be understood that elastomeric member 40 may also be radially outwardly expanded into contact with an annular wall (not separately labeled) defined by formation 26. Packer assembly 36 also includes a first gauge ring 44 and a second gauge ring 45. One of first and second gauge rings 44, 45 may be fixedly mounted relative to tubular 21 while another of gauge rings 44, 45 may be shiftable and thereby define an activation ring.

Packer assembly 36 is also shown to include a first expansion ring 48 and a second expansion ring 49. First and second expansion rings 48 and 49 may be c-shaped or non c-shaped. First and second expansion rings 48, 49 are arranged between corresponding ones of first and second gauge rings 44, 45 and elastomeric member 40. Additionally, packer assembly 36 includes a first back-up ring 104 and a second backup ring 105. Each back-up ring 104 and 105 includes a corresponding axial end 107 and 108 defining corresponding first and second pockets 110 and 111. First and second pockets 110 and 111 are receptive of a portion of elastomeric member 40. A first support ring 114 buttresses first back-up ring 104 and a second support ring 116 buttresses second back-up ring 105. That is, first and second support rings 114 and 116 prevent corresponding ones of axial ends 107 and 108 from deforming during high pressure setting operations. In operation, one of gauge rings 44 and 45 is shifted towards the other of gauge rings 44 and 45, causing elastomeric member 40 to expand axially outwardly.

Reference will now follow to FIG. 3 in describing first expansion ring 48 and first support ring 114 with an understanding that second expansion ring 49 and second support ring 116 may include similar structure. Expansion ring 48 includes a radially outwardly facing surface 124, a radially inwardly facing surface 125, a first axially facing surface 126, and a second axially facing surface 128. In accordance with an exemplary aspect, second axially facing surface 128 faces support ring 114. Support ring 114 includes a radially outwardly facing surface section 134, a radially inwardly facing surface section 136, a first axially facing surface section 138 and a second axially facing surface section 140. First axially facing surface section 138 faces first expansion ring 48.

At this point, it should be understood that the term "radially outwardly facing surface" defines a surface that extends substantially perpendicularly to a radial axis of tubular string 20 that faces annular wall 28; the term "radially inwardly facing surface" defines a surface that extends substantially perpendicularly to a radial axis of tubular string 20 that faces tubular 21; and the term "axially facing surface" defines a surface that is substantially perpendicular to a longitudinal axis of tubular string 20.

Figure 4:
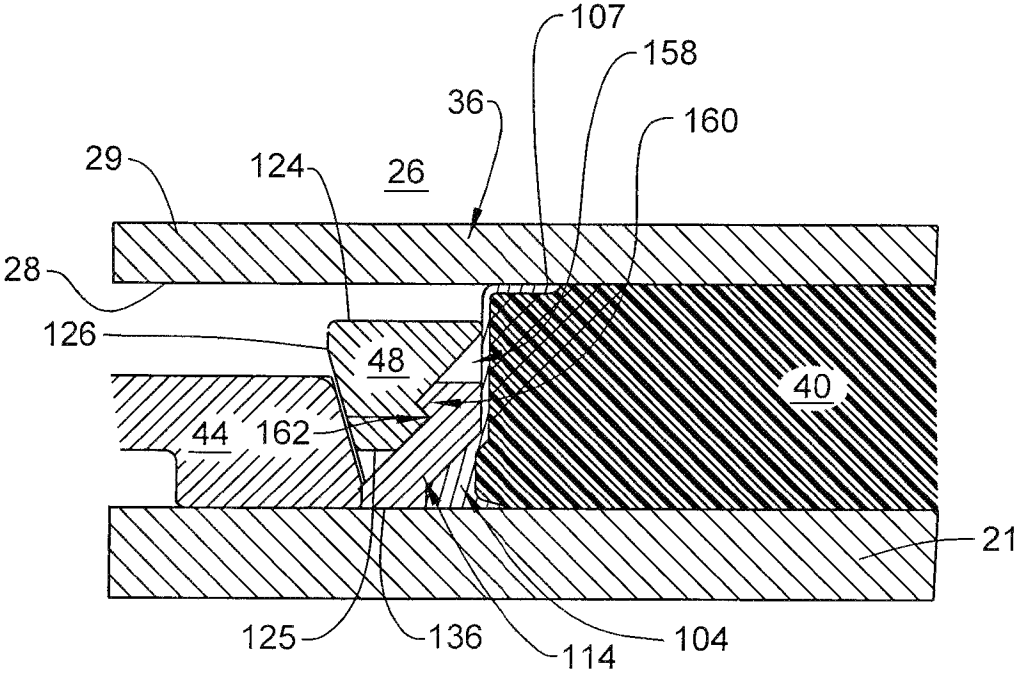
FIG. 4 is a partial sectional view of the packer assembly of FIG. 3 showing the packer in a deployed configuration.

More specifically, when in position, second gauge ring 45 may be shifted toward first gauge ring 44 thereby exerting a compressive force on elastomeric member 40. The compressive force causes elastomeric member 40 to expand radially outwardly into contact with wellbore casing 29 as shown in FIG. 4. Radial outward expansion of elastomeric member 40 causes axial ends 107 and 108 of back-up rings 104 and 105 respectively to bend or flex.

Expansion rings 48 and 49 are placed so as to prevent any over bending or flexing of back-up rings 104 and 105. That is, over bending could cause axial ends 107 and 108 to abruptly change direction allowing elastomeric member 40 to expand axially. Axial expansion of elastomeric member 40 is undesirable. It has been found that, for example, when elastomeric member 40 expands, first axial surface 126 of expansion ring 48 is supported by gauge ring 44 and second axial surface 130 of expansion ring 48 is supported by support ring 114. This arrangement leads to positive moments on expansion ring 48 that leads to rocking. The rocking may reduce a contact area with first back-up ring 104 and thus provide a degraded amount of support.

Figure 5:
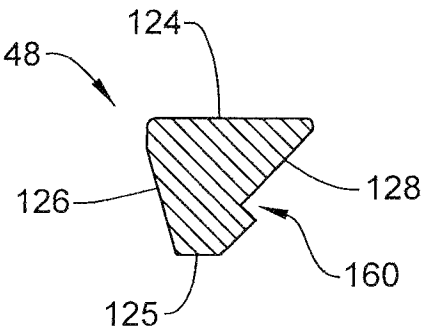
FIG. 5 depicts a moment diagram of a support ring of the packer assembly in accordance with an aspect of an exemplary embodiment.

In order to prevent rocking, first expansion ring 48 and first support ring 114 include an interlock feature 158 that creates a negative moment, as shown in FIG. 5, that cancels the first and second positive moments. It should be understood that second expansion ring 49 and second support ring 116 includes a similar interlock feature. Interlock feature 158 includes a step portion 160 defined by a recess provided on second axially facing surface 128 of expansion ring 48 and a step feature 162 defining a recess section provided on first axially facing surface section 138 of support ring 114.

Step portion 160 is spaced from inwardly facing surface 125. In an embodiment, step portion 160 is arranged between inwardly facing surface 125 and a mid-point (not separately labeled) of second axially facing surface 128. Step feature 162 is provided adjacent outwardly facing surface section 134. With this arrangement, as step portion 160 and step feature 162 come together, interlock feature 158 prevents rocking or twisting of expansion ring 48.

By preventing rocking, first and second expansion ring 48 establishes a desired gap (not separately labeled) having a substantially uniform dimension between radially outward facing surface 124 and annular wall 28 of wellbore 24. The particular size of the gap may vary and may depend on tubular diameter. However, the uniform dimension provides added support to back-up ring 104 packer assembly 36 to be utilized in a larger array of applications without concern that a back-up ring may shear or otherwise bend and shift over or toward a corresponding expansion ring.

Set forth below are some embodiments of the foregoing disclosure:

Embodiment 1: A packer assembly comprising: a tubular having a surface; a gauge ring provided on the surface; a back-up ring positioned adjacent the gauge ring; a packer element arranged adjacent to the back-up ring; an expansion ring arranged adjacent to the gauge ring, the expansion ring including a step portion; and a support ring arranged axially between the back-up ring and the expansion ring, the support ring including a step feature, the step portion and the step feature being selectively engaged with expansion of the packer element to form an interlock feature that substantially limits rocking of the expansion ring.

Embodiment 2: The packer assembly according to any prior embodiment, wherein the support ring includes a radially outwardly facing surface section, a radially inwardly facing surface section selectively abutting the surface of the tubular, a first axially facing surface section, and a second axially facing surface section, the step feature defining a recess formed in the first axially facing surface section.

Embodiment 3: The packer assembly according to any prior embodiment, wherein the recess is arranged adjacent the radially outwardly facing surface section.

Embodiment 4: The packer assembly according to any prior embodiment, wherein the step portion defines a recess portion formed in the second axially facing surface section.

Embodiment 5: The packer assembly according to any prior embodiment, wherein the recess is formed adjacent the radially inwardly facing surface section.

Embodiment 6: The packer assembly according to any prior embodiment, wherein the recess is formed between the radially inwardly facing surface section and a mid-point of the second axially facing surface section.

Embodiment 7: A resource exploration and recovery system comprising: a surface system; and a downhole system including a string of tubulars, at least one of the string of tubulars including a surface supporting a packer assembly comprising: a gauge ring provided on the surface; a back-up ring positioned adjacent the gauge ring; a packer element arranged adjacent to the back-up ring; an expansion ring arranged adjacent to the gauge ring, the expansion ring including a step portion; and a support ring arranged axially between the back-up ring and the expansion ring, the support ring including a step feature, the step portion and the step feature being selectively engaged with expansion of the packer element to form an interlock feature that substantially limits rocking of the expansion ring.

Embodiment 8: The resource exploration and recovery system according to any prior embodiment, wherein the support ring includes a radially outwardly facing surface section a radially inwardly facing surface section selectively abutting the surface of the tubular, a first axially facing surface section, and a second axially facing surface section, the step feature defining a recess formed in the first axially facing surface section.

Embodiment 9: The resource exploration and recovery system according to any prior embodiment, wherein the recess is arranged adjacent the radially outwardly facing surface section.

Embodiment 10: The resource exploration and recovery system according to any prior embodiment, wherein the step portion defines a recess portion formed in the second axially facing surface section.

Embodiment 11: The resource exploration and recovery system according to any prior embodiment, wherein the recess is formed adjacent the radially inwardly facing surface section.

Embodiment 12: The resource exploration and recovery system according to any prior embodiment, wherein the recess is formed between the radially inwardly facing surface section and a mid-point of the second axially facing surface section.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A packer assembly comprising:

a tubular having a surface;

a gauge ring provided on the surface;

a back-up ring spaced from the gauge ring;

a packer element arranged adjacent to the back-up ring;

an expansion ring arranged adjacent to the gauge ring, the expansion ring including a radially outwardly facing surface, a radially inwardly facing surface, a first axially facing surface, a second axially facing surface, and a step portion; and a support ring arranged axially between the back-up ring and the expansion ring, the support ring including a step feature, the step portion and the step feature being selectively engaged with expansion of the packer element to form an interlock feature that substantially limits rocking of the expansion ring and maintains a selected gap between the radial outward facing surface and a casing positioned outwardly of the tubular.

2. The packer assembly according to claim 1, wherein the support ring includes a radially outwardly facing surface section, a radially inwardly facing surface section selectively abutting the surface of the tubular, a first axially facing surface section, and a second axially facing surface section, the step feature defining a recess section formed in the first axially facing surface section.

3. The packer assembly according to claim 2, wherein the recess section is arranged adjacent the radially outwardly facing surface section.

4. The packer assembly according to claim 2, wherein the step portion defines a recess portion formed in the second axially facing surface.

5. The packer assembly according to claim 4, wherein the recess portion is formed adjacent the radially inwardly facing surface.

6. The packer assembly according to claim 5, wherein the recess portion is formed between the radially inwardly facing surface and a mid-point of the second axially facing surface.

7. A resource exploration and recovery system comprising:

a surface system; and a downhole system including a string of tubulars, at least one of the string of tubulars including a surface supporting a packer assembly comprising:

a gauge ring provided on the surface;

a back-up ring spaced from the gauge ring;

a packer element arranged adjacent to the back-up ring;

an expansion ring arranged adjacent to the gauge ring, the expansion ring including a radially outwardly facing surface, a radially inwardly facing surface, a first axially facing surface, a second axially facing surface, and a step portion; and a support ring arranged axially between the back-up ring and the expansion ring, the support ring including a step feature, the step portion and the step feature being selectively engaged with expansion of the packer element to form an interlock feature that substantially limits rocking of the expansion ring and maintains a selected gap between the radial outward facing surface and a casing positioned outwardly of the tubular.

8. The resource exploration and recovery system according to claim 7, wherein the support ring includes a radially outwardly facing surface section a radially inwardly facing surface section selectively abutting the surface of the tubular, a first axially facing surface section, and a second axially facing surface section, the step feature defining a recess section formed in the first axially facing surface section.

9. The resource exploration and recovery system according to claim 8, wherein the recess section is arranged adjacent the radially outwardly facing surface section.

10. The resource exploration and recovery system according to claim 8, wherein the step portion defines a recess portion formed in the second axially facing surface.

11. The resource exploration and recovery system according to claim 10, wherein the recess portion is formed adjacent the radially inwardly facing surface.

12. The resource exploration and recovery system according to claim 11, wherein the recess portion is formed between the radially inwardly facing surface and a mid-point of the second axially facing surface.

* * * * *